United States Patent [19]

Akers

[11] 4,281,968

[45] Aug. 4, 1981

[54] WATER STORAGE AND PUMPING SYSTEM

[76] Inventor: Francis A. Akers, 355 Peachtree St. N.E., Atlanta, Ga. 30308

[21] Appl. No.: 935,471

[22] Filed: Aug. 21, 1978

[51] Int. Cl.[3] ..... F04B 49/02; F04B 49/06

[52] U.S. Cl. ..... 417/2; 417/44

[58] Field of Search ..... 417/12, 38, 44

[56] References Cited

U.S. PATENT DOCUMENTS

| | | | |
|---|---|---|---|
| 1,416,092 | 5/1922 | Knaak | 417/28 |
| 1,838,228 | 12/1931 | Kershaw | 417/28 |
| 1,936,821 | 11/1933 | Bizzarri | 417/28 |
| 2,720,355 | 10/1955 | Curdmyer | 417/27 |
| 3,457,864 | 7/1969 | Price | 417/44 |
| 3,563,671 | 2/1971 | Weber | 417/38 |
| 4,180,374 | 12/1979 | Bristow | 417/26 |

*Primary Examiner*—William L. Freeh

*Attorney, Agent, or Firm*—Richard W. Hanes

[57] ABSTRACT

A water storage and pumping system with a motor control for the pump, which is responsive to storage tank pressure and comprises an analog pressure tank and a low pressure responsive valve to admit water from the storage tank service line to the pressure tank and a high pressure responsive valve which allows the pressure tank to drain through a time delay bleed valve. A pressure responsive electrical switch senses the pressure tank pressure and controls operation of the pump.

4 Claims, 2 Drawing Figures

WATER STORAGE AND PUMPING SYSTEM

The present invention relates to a self controlled pumping system of the kind which employs one or more pressure controlled pumps for pumping water to a storage tank located at a higher level than the pumps. More specifically the invention comprises control system improvements to such a system which uses a single line for both service and supply. Prior systems of the type described suffer from problems of erratic pump operation during periods of high water usage which results in pressure surges in the service line, especially where a single supply and service line is employed.

The primary object of the present invention is to provide apparatus for maintaining at least a minimum pressure in the service line connected to the storage tank.

A second object of the present invention is to provide apparatus for modeling or analoging the water pressure in the storage tank and providing a timing device in conjunction therewith so as to sense a pressure for pump operation which is more truly indicative of the water level in the storage tank than is the water pressure which is sensed in the service line. Service line pressure is influenced not only by the hydrostatic head in the line but by the reductions in pressure caused by frequent or heavy water draw down.

Other objects, features and advantages of the present invention will become apparent upon a reading of the following detailed description of a preferred form and alternative form of the present invention taken in conjunction with the accompanying drawings in which.

Figure 1:
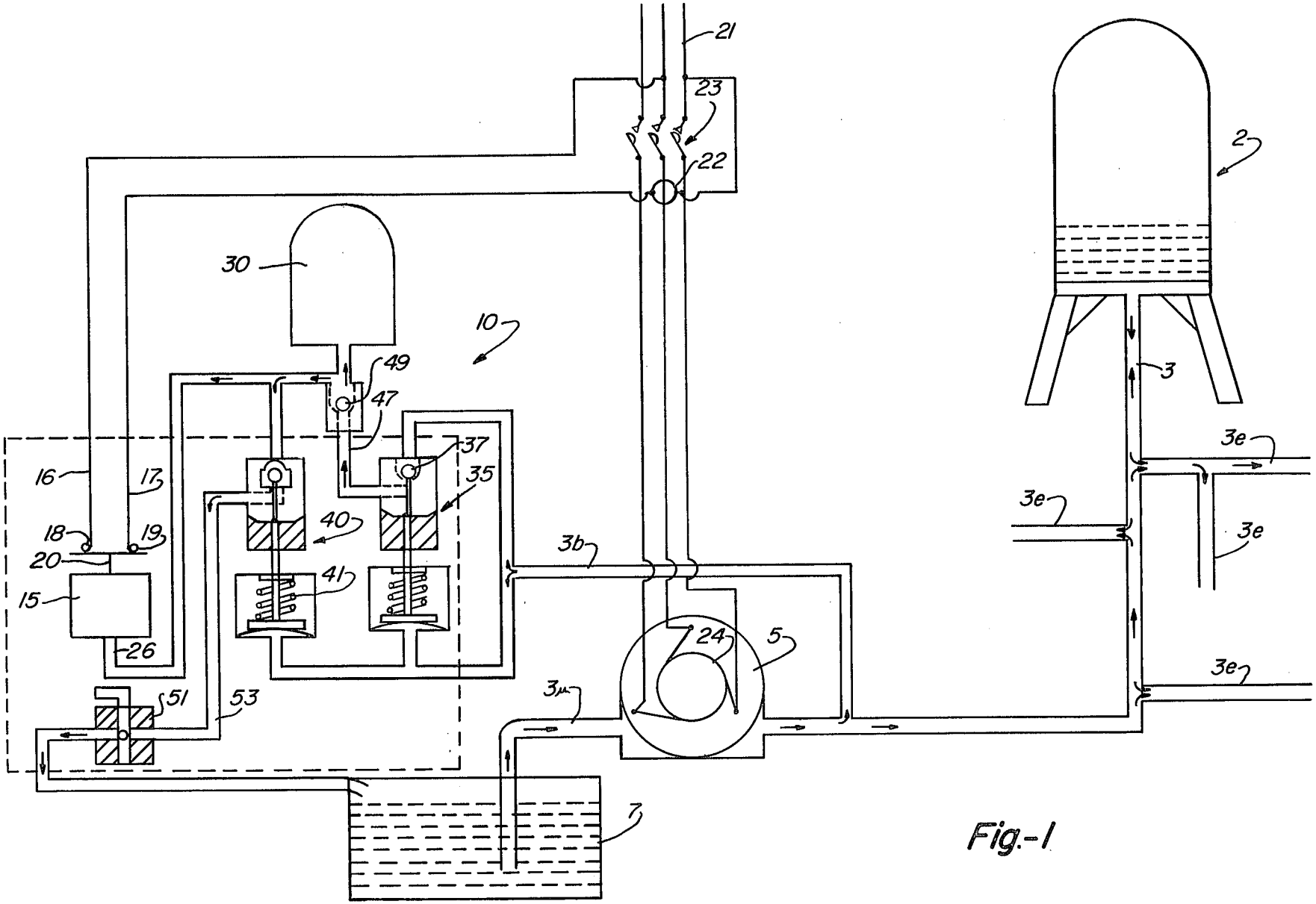
FIG. 1 is a diagrammatic block diagram of the water system of the present invention.

Referring first to FIG. 1 an elevated water storage tank 2 is diagrammatically depicted as having a single line 3 for both supply and service. Service branches of the line are shown with reference numerals 3*e*.

An electrically operated pump 5 is serially connected in the supply portion of the line 3*u* between a low source of water 7 and the elevated storage tank 2. A branch water line 3*b* diverts water from the main line 3 to the analoging and sensing device 10 of the present invention. The ultimate objective of the sensing device 10 is the activation or deactivation of a pressure responsive spring operated electrical switch 15. Electrical leads 16 and 17 are attached to the contacts 18 and 19 respectively of switch 15. As the contacts of switch 15 open or close by reciprocal movement of the switch piston 20 electrical current is either supplied or cut off to the relay coil 22 which opens or closes the relay contacts 23 in series with the three phase electrical supply 21 for the pump motor 24, operatively connected to the water pump 5.

The switch 15 is of a type well known in the art that is responsive to the pressure in a water line 26 which is connected to the water pressure tank 30, forming part of the sensing device 10.

Before describing the apparatus and operation of the sensing device 10 it should be made apparent that the pump 5 is operated in response to the pressure in the water line 26 which is isolated from the main water line 3.

As stated earlier, the objective of good control is to turn the pump on when the water level in the tank drops to a given level and then turn the pump off when the water has reached a desired level in the tank. The sensing of hydrostatic head pressure is the most advantageous method of determining the water level. For purposes of illustration 60 p.s.i. can be taken as the head pressure that indicates the need for filling the tank. Sensing the 60 p.s.i. in the service line and controlling the motor as a function thereof is not reliable because of pressure fluctuations caused by draw down in the service lines.

By means of the analog sensing device 10 the head pressure and water line condition of the storage tank 2 can be simulated and the pump 5 operated accordingly.

The sensing device comprises a pair of pressure sensitive spring operated valves diagrammatically illustrated and referred to generally by numbers 35 and 40. The valves are oppositely biased so that the water pressure in line 3*b* which will open the valve 35 will also allow the second valve to close. Opening of the first valve 35 allows water to pass from the supply line 3*b* into line 47 and past the one way check valve 49 into the pressure tank 30 and also into the snap switch pressure line 26. The opening of the second valve 40 allows the water which is under pressure in the tank 30 and the snap switch line 26 to return to the source 7 through a selectively operable bleed valve 51 connected to the output side of the valve 40 by a conduit 53. The bleed valve 51 may be set to allow the water to pass at varying rates.

To understand the operation of the sensing device a filling cycle is described starting at a point where the line 26 and the pressure tank 30 are empty. Without pressure in the line 26 the switch 15 contacts are closed and electrical current flows through the switch contacts 18 and 19 and into the relay coil 22, closing the contacts 23 and causing the pump to operate and to begin filling the tank 2. At such time as the head pressure reaches the selected amount, say 60 p.s.i., the first valve 35 will open, allowing the pump output and the storage tank head pressure to be felt by the switch 15 and causing the pressure tank 30 to fill against its internal air pressure. As the head pressure increases due to continued filling of the tanks 2 and 30 a cutoff pressure, say 80 p.s.i., is finally reached in the lines 3, 3*b* and 26. At this pressure the switch 15 opens and power to the pump motor 24 is terminated. Until the water level in the tank 2 is reduced to a point represented by the minimum selected pressure (60 p.s.i.) the valve 35 remains open and the pressure tank remains full, and at its highest pressure level, which was reached at the highest pressure level of the storage tank 2. Because of the ball check valve 49 the pressure in the tank 30 cannot be diminished because when the pressure in line 47 drops (say less than 80 p.s.i.) the check valve 49 closes, thus preventing bleed off of the pressure in the tank 30 and keeping the switch 15 in an open position.

When water use lowers the pressure in the lines 3 and 3*b* to the minimum (60 p.s.i.) the first valve 35 closes and the second valve 40 opens, the latter open valve allowing the bleed-off of pressure in the pressure tank 30 and line 26 to a predetermined low pressure and the consequent closing of the switch 15 to start the pump. The switch 15 is of a well known type which when closed will remain closed until a certain transducer pressure is reached, at which point the switch will open. Once open, the switch will remain open until the pressure decreases to a given value, at which point the switch will close. The opening pressure and closing pressure are different (in the example, 80 p.s.i. is the opening pressure while 60 p.s.i. is the closing pressure when the pressure is coming from high to low). The delay in pressure reduction provided by the bleed valve 51 introduces a time factor into the sensing device that immunizes the system from reaction to pressure fluctuations which may be momentarily or temporarily caused by a high rate of draw down in the service lines *3e* and which would not actually signify a low water level in the tank 2 to which the pump 5 should respond.

Figure 2:
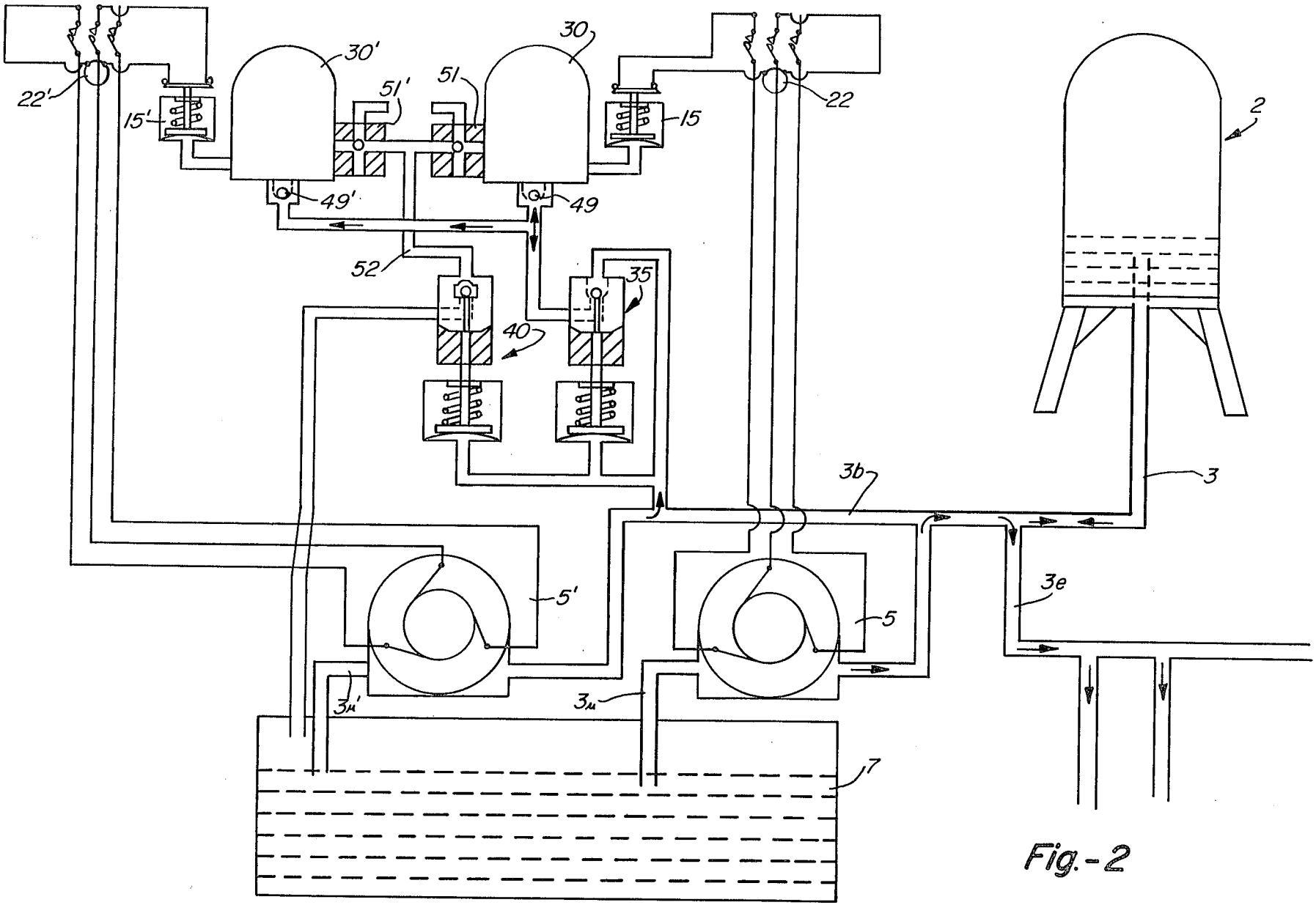
FIG. 2 is a diagrammatic block diagram of an alternative form of the present invention using two pumps and motors.

FIG. 2 describes a second embodiment of the basic invention of FIG. 1 wherein a sensing system is provided for the selective control of two pumps 5 and 5'. Pressure tanks 30 and 30' are connected in parallel to the output side of the first sensing valve 35. Pressure sensitive spring operated switches 15 and 15' are fluid connected to the respective pressure tanks 30 and 30'. The switches are electrically connected to the relay coils 22 and 22' in the same manner as described for the embodiment of FIG. 1. Bleed valves 51 and 51' are connected to an output line of the respective tanks 30 and 30' and their outputs converge to be directed by a drain line 52 into the second sensing valve 40 whose output side is connected by suitable conduit back to the water source 7.

By arranging different pressure reaction points for the switches 15 and 15' it will be seen that as the storage tank 2 approaches a full condition and the storage tank pressure is felt through the reverse flow check valves 49 and 49' and by the switch transducers, snap switch 15' will open first, at a lower pressure, causing the second pump 5' to shut down. The first pump 5 continues to operate until the greater pressure which will actuate the snap switch 15 is achieved in the tank 2 and the lines 3 and pressure tank 30.

Similarly, under conditions of high use and rapid draw down of the water in the storage tank 2 the pumps 5 and 5' can be made to turn on at different times by selective adjustment of the bleed valves 51 and 51'. Under conditions of a high water use rate the bleed valve 51 may be adjusted to allow the pressure tank 30 to drain faster than the pressure tank 30'. In such a case the first pump 5 would turn on. If the use rate were such as to be taken care of by the first pump 5 and allow output of the pump 5 to also fill the tank 2, the tank may become filled before the time delay bleed valve 51' has had sufficient time to allow the second pump 5' to turn on. On the other hand if the rate of use of water is high enough that the first pump cannot adequately handle the load and fill the tank 2 also, then after an appropriate wait the second pump 5' will be turn on to assist the first pump.

I claim:

1. A pressure responsive motor control system comprising:

at least one electrical motor;

a source of electrical power;

pressure responsive switching means interconnecting the motors and the source of electrical power;

first and second oppositely operating pressure responsive fluid valves, each having fluid inputs and outputs;

a source of fluid pressure connected in parallel to the said pair of valves and to the input of the first valve;

at least one pressure tank;

means interconnecting the tanks to the output of the first valve including a reverse flow check valve;

drain means connected to the tank, including at least one bleed valve and the second valve; and conduit means interconnecting the tank and the switching means.

2. A water storage and pumping system comprising:

an elevated storage tank;

a source of water;

electric pump means having an output and interconnecting the water source and the storage tank;

a pressure tank;

first pressure responsive valve means interconnecting the pressure tank and the pump output;

pressure tank drain means connected to the pressure tank, including selectively operable bleed valve means and second pressure responsive valve means connected to the pump output;

pressure responsive switching means connected to the pressure tank and electrically connected to the pump means.

3. The combination of claim 2 wherein the said first valve means is openable at a given pressure and the second valve means closes at the said given pressure.

4. The combination of claim 3 wherein the first pressure responsive valve means includes a reverse flow check valve.

* * * * *